US006490229B1

(12) United States Patent
Caver

(10) Patent No.: US 6,490,229 B1
(45) Date of Patent: Dec. 3, 2002

(54) TROLLING MOTOR TRANSDUCER MOUNT

(76) Inventor: John T. Caver, 4401 Sermetel Dr., Moss Point, MS (US) 39563

( * ) Notice: Subject to any disclaimer, the term of this patent is extended or adjusted under 35 U.S.C. 154(b) by 0 days.

(21) Appl. No.: 09/990,945

(22) Filed: Nov. 9, 2001

(51) Int. Cl.[7] ..... H04R 1/00
(52) U.S. Cl. ..... 367/173
(58) Field of Search ..... 367/165, 173; 248/226.11, 640

(56) References Cited

U.S. PATENT DOCUMENTS 3,880,106 A * 4/1975 Farmer ..... 367/165
3,907,239 A * 9/1975 Ehrlich ..... 248/229.26
4,152,690 A * 5/1979 Veatch ..... 248/278.1
4,926,399 A * 5/1990 Hickman ..... 367/173
5,573,221 A * 11/1996 Reeves ..... 367/173

OTHER PUBLICATIONS

The Stump Bumper; www.stumpbumper.com.
Tricks for Mounting Transducers to Electric Trolling Motors; www.sona–graf.com.
Puck Transducer Installation; www.sona–graf.com.

* cited by examiner

*Primary Examiner*—Ian J. Lobo
(74) *Attorney, Agent, or Firm*—Phelps Dunbar, L.L.P.

(57) ABSTRACT

The Trolling Motor Transducer Mount ("TMTM") is a device which allows a transducer, as would be used for sonar depth-finding equipment commonly used by fishermen, to be rigidly but removably mounted onto a trolling motor. The secure attachment prevents the transducer from being knocked loose and lost or knocked out of alignment due to impact from underwater obstructions while the trolling motor is propelling the boat. It also shields the transducer from direct impact with underwater obstructions, preventing damage to the transducer. The TMTM is formed of a housing for the transducer, two brackets which are each rigidly attached at one end to the housing and then extend out to form a circular collar with an open end, and a means for clamping the open ends of the brackets closer together. The open circular collar slides onto the trolling motor. Once in place, the clamping mechanism reduces the radius of the collar until it is tightly secured in place on the trolling motor. The TMTM may also have a groove along the inner surface of one of the brackets for holding the wires of the transducer, so that they will not snag on underwater obstructions.

26 Claims, 3 Drawing Sheets

TROLLING MOTOR TRANSDUCER MOUNT

BACKGROUND OF THE INVENTION

Recreational and sporting fishermen often use a transducer, typically a sonar unit for detecting depth and/or for locating fish, as part of the basic equipment they take with them on each fishing trip. Often, they will mount their transducer on the bottom of their trolling motor, as this provides a convenient location for the transducer. This is particularly true for depth-finding sonar units, which should be directed straight down under the surface of the water in order to function properly. Unfortunately, locating the transducer on the trolling motor subjects the transducer to difficult conditions which may lead to a malfunction of the transducer mechanism, misalignment of the transducer, or even loss of the transducer.

There are many underwater obstructions and hazards located beneath the surface of the water in boating areas. As a result, the trolling motor may bump or snag various underwater obstructions. This subjects a transducer mounted on the trolling motor to impact, which may jar the transducer severely. Such impacts may result in damage to the sensitive mechanisms of the transducer. They may also lead to the transducer's position on the trolling motor being altered, which may adversely affect the transducer's ability to provide accurate information. The wires leading from the transducer up to the user in the boat may also snag on underwater obstructions, damaging the electrical components of the transducer. In the worst case scenario, such impacts may even tear the transducer loose from the trolling motor, in which case the transducer can be lost. In fact, most professional sports fishermen lose several transducers each year in this manner.

The current method for mounting a transducer upon a trolling motor uses either a large cable tie or a metal hose clamp to tie the transducer directly onto the bottom of the trolling motor. The transducer is unprotected and completely exposed to underwater obstructions, and the wires from the transducer also hang freely and are exposed, so that they may snag or snare upon underwater obstructions. Furthermore, the cable tie or hose clamp is not particularly strong, since it was not designed for this particular type of task. As a result, the cable tie or hose clamp will often break if the transducer hits some underwater obstruction during trolling, and the transducer will be knocked free of the trolling motor. Even if the metal hose clamp does not actually break, the transducer will often be either knocked out of alignment or jarred sufficiently so that the electronic mechanisms malfunction. Finally, when the trolling motor is in use, it may produce interference with the electronic data of the transducer.

The instant invention, referred to as a Trolling Motor Transducer Mount ("TMTM"), was developed to overcome these problems which typically arise when a transducer is operated from a position on a trolling motor. The TMTM provides a means for durably fixing a transducer upon a trolling motor. Because of the design of the TMTM, the transducer is much less likely to be torn off of the trolling motor. Indeed, the strength of the attachment provided by the TMTM also reduces the chances that the transducer will be knocked out of alignment. The TMTM also shields the transducer from direct exposure to underwater obstructions, so that the electronic mechanisms in the transducer are less likely to be jarred to the point of malfunctioning. The TMTM provides a convenient location for the wires leading from the transducer up to the user in the boat, so that the wires are not exposed to the elements in a manner that would allow for snagging to occur; rather, the wires are shielded within the TMTM. Enclosing the transducer within the TMTM also shields the transducer from interference when the trolling motor is operated. Finally, the TMTM allows the transducer to be easily removed from its position on a trolling motor. One embodiment of the TMTM even includes a convenient temperature probe, which is mounted on the TMTM so that the user may detect the temperature of the water beneath the surface. Obviously, the TMTM solves many of the problems which recreational and sporting fishermen have encountered using the current technology to affix transducers to trolling motors.

SUMMARY OF THE INVENTION

Generally, the present invention relates to mounting a transducer upon a trolling motor, although the present invention is not limited to such use. An object of the present invention is to durably but removably mount a transducer to the bottom of a trolling motor. Another object of the present invention is to rigidly affix a transducer to a position on a trolling motor, so that even if the transducer is bumped or jarred, its position will not be substantially altered. Yet another object of the present invention is to protect and shield the mechanisms of a transducer mounted to a trolling motor from direct impact which could damage or disrupt the functioning of the transducer. Yet another object of the present invention is to hold the wires of the transducer in a manner which reduces the chances that they may snag or snare upon underwater obstructions. Yet another object of the present invention is to shield the transducer and its wires from interference when the trolling motor is in operation. Yet another object of the present invention is to provide a location to durably mount instruments, such as a temperature probe, underneath the surface of the water. Yet another object of the invention is to resist the corrosive environment underneath the surface of the water. A person skilled in the art field will understand these and other uses and objects for the present invention.

The TMTM is comprised of a circular collar which is open at one end. A housing with a recess, in which a standard transducer (such as LOWRANCE® and HUMMINBIRD® transducers) may be mounted, is attached to the circular collar. The housing may be attached anywhere along the circumference of the circular collar, but in the preferred embodiment the housing is located at the closed end of the circular collar. A standard transducer may be mounted in the recess so that it is enclosed within the TMTM and shielded by the TMTM from direct impact. The other end of the circular collar is open and is configured to allow for the open end to be clamped together in order to form a solid ring surrounding the circumference of the trolling motor. When the circular collar is open, it is sized so that it loosely fits around the housing of a standard trolling motor. Thus, when the circular collar is open and unclamped, it may be easily installed onto a trolling motor by simply sliding onto the housing of the trolling motor. When installing the TMTM upon a trolling motor, the recess is typically positioned so that, when the trolling motor is in use and is positioned beneath the surface of the water so as to drive a boat, the recess will face directly down towards the bottom of the body of water. Once the TMTM is properly positioned on the trolling motor, the open end of the TMTM is clamped together so that the TMTM acts as a solid collar encompassing the diameter of the trolling motor housing. This clamping action also causes the diameter of the TMTM to be reduced, so that the TMTM fits snugly onto the trolling motor housing. In essence, this clamping action causes the TMTM to lock into position on the trolling motor housing, with the friction between the inner surface or the TMTM and the trolling motor housing preventing any movement of the TMTM with respect to the trolling motor housing.

Typically, the open end of the TMTM is designed with flanges with bolt holes. Once the TMTM is properly positioned on the trolling motor housing, bolts are inserted through the holes in the flanges, and nuts are attached to the free end of the bolts. Once the nuts are tightened, the flanges will be pressed tightly together in order to close the open end of the TMTM so that it forms a solid circular collar tightly encompassing the trolling motor. In this way, the entire TMTM acts as a clamp, which may be properly located on the trolling motor when open but which is securely fastened to the trolling motor when it is closed and fixed shut.

The TMTM may also have an internal feature which holds the wires from the transducer inside of the TMTM so that they may not snag on any underwater obstructions. Typically, this is accomplished using a groove along the inner surface of the TMTM, along with a slot formed when the two flanges are joined together. The wires from the transducer are fed through the groove along one side of the TMTM and then exit through the slot between the flanges. Typically, the TMTM would be mounted close to the shaft of the trolling motor leading up out of the water. In that case, the wires from the transducer would exit through the slot, which is positioned atop the trolling motor, and could be attached to run up along the shaft, so that the wires would not hang freely but would be secured tightly along the profile of the trolling motor to reduce the chances of snagging.

Although the TMTM may be made adjustable in order to fit different sizes of trolling motors, in the preferred embodiment, different size TMTM devices are designed for use with different sizes of trolling motors. As most of the trolling motor market is made up of two specific sizes of trolling motors (namely the MOTORGLIDE® or standard MINN KOTA® with a diameter of approximately 3.710 inches and MAGNUM MINN KOTATM with a diameter of approximately 4.025 inches), typically there may be two different versions of the TMTM device, sized to fit the two primary types of trolling motors. Obviously, similar TMTM devices could be made to fit other trolling motors. Due to the substantial size of the TMTM encompassing a trolling motor, which is much wider and thicker than the hose clamps currently employed, the TMTM is much sturdier and is much better able to resist damage. Also, the larger surface area and the clamping mechanism for locking the TMTM in place on a trolling motor produces a much firmer attachment to the trolling motor.

Durability may also be increased by employing specific techniques in constructing the TMTM. Typically, a TMTM would be machined out of a solid block of aluminum and then anodized. The anodized aluminum provides a good combination of lightweight strength and corrosion resistance. Machining the device out of a solid block of metal also ensures greater strength than if the device were cast. Other construction techniques and materials may obviously be employed, so long as they provide the requisite strength and corrosion resistance.

Finally, the TMTM may serve as a solid location to mount other instrumentation which needs to be placed under the surface of the water. So for example, a temperature probe could be affixed to the outer surface of the TMTM, so that when the trolling motor to which the TMTM is mounted is in use, the temperature gauge would provide the user with the temperature of the water beneath the surface. Such information about the conditions of the water may prove useful to recreational and sporting fishermen.

BRIEF DESCRIPTION OF THE DRAWINGS

Reference will be made to the drawings, where like parts are designated by like numerals and wherein.

DETAILED DESCRIPTION OF THE INVENTION

Figure 2:
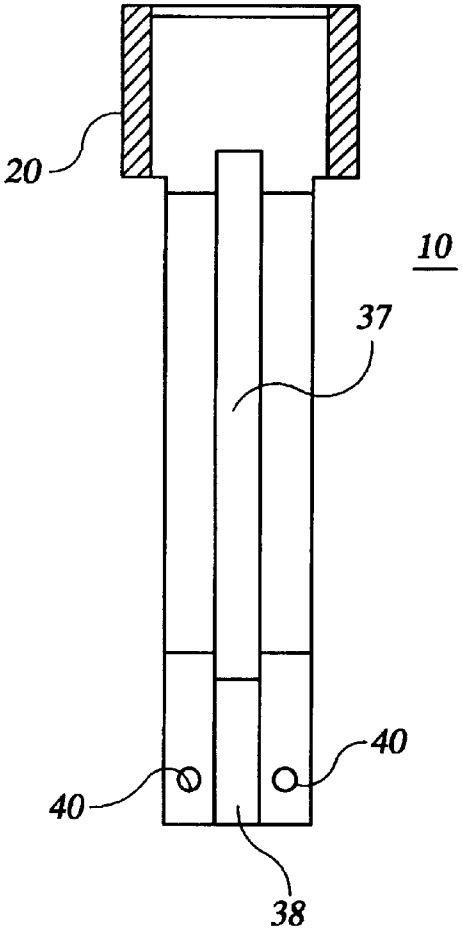
FIG. 2 is a sectional view of the TMTM along line A-A in FIG. 1, showing one half of the inner surface of the TMTM.
Figure 1:
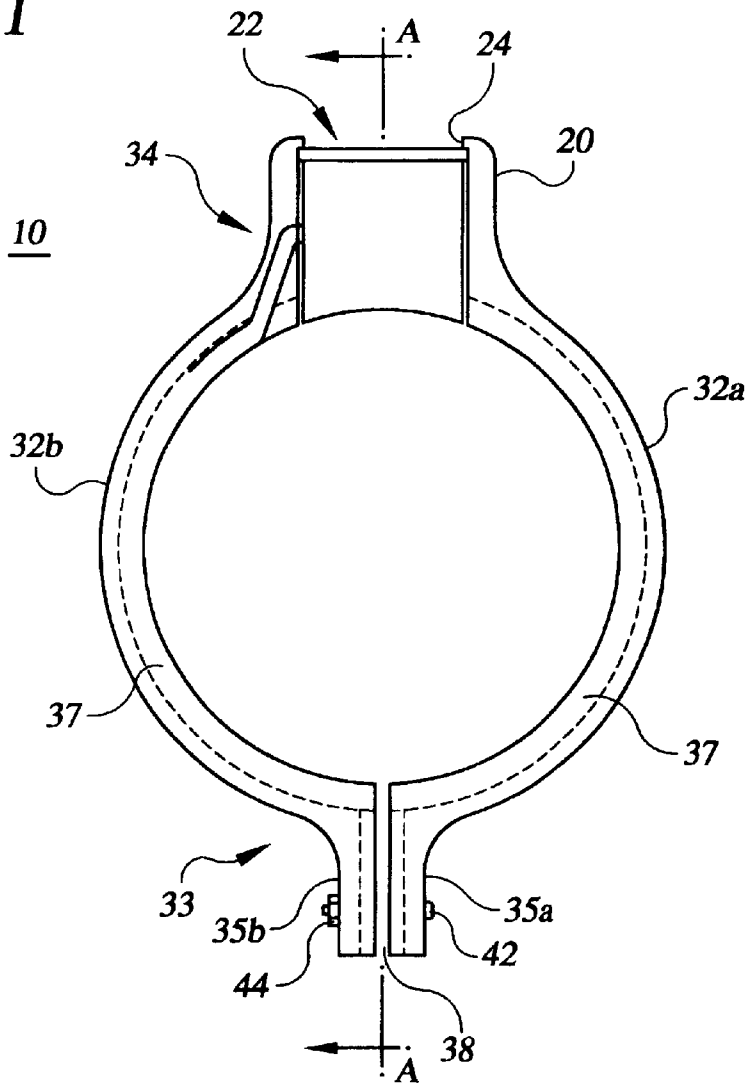
FIG. 1 is a front, radial view of the TMTM.
Figure 3:
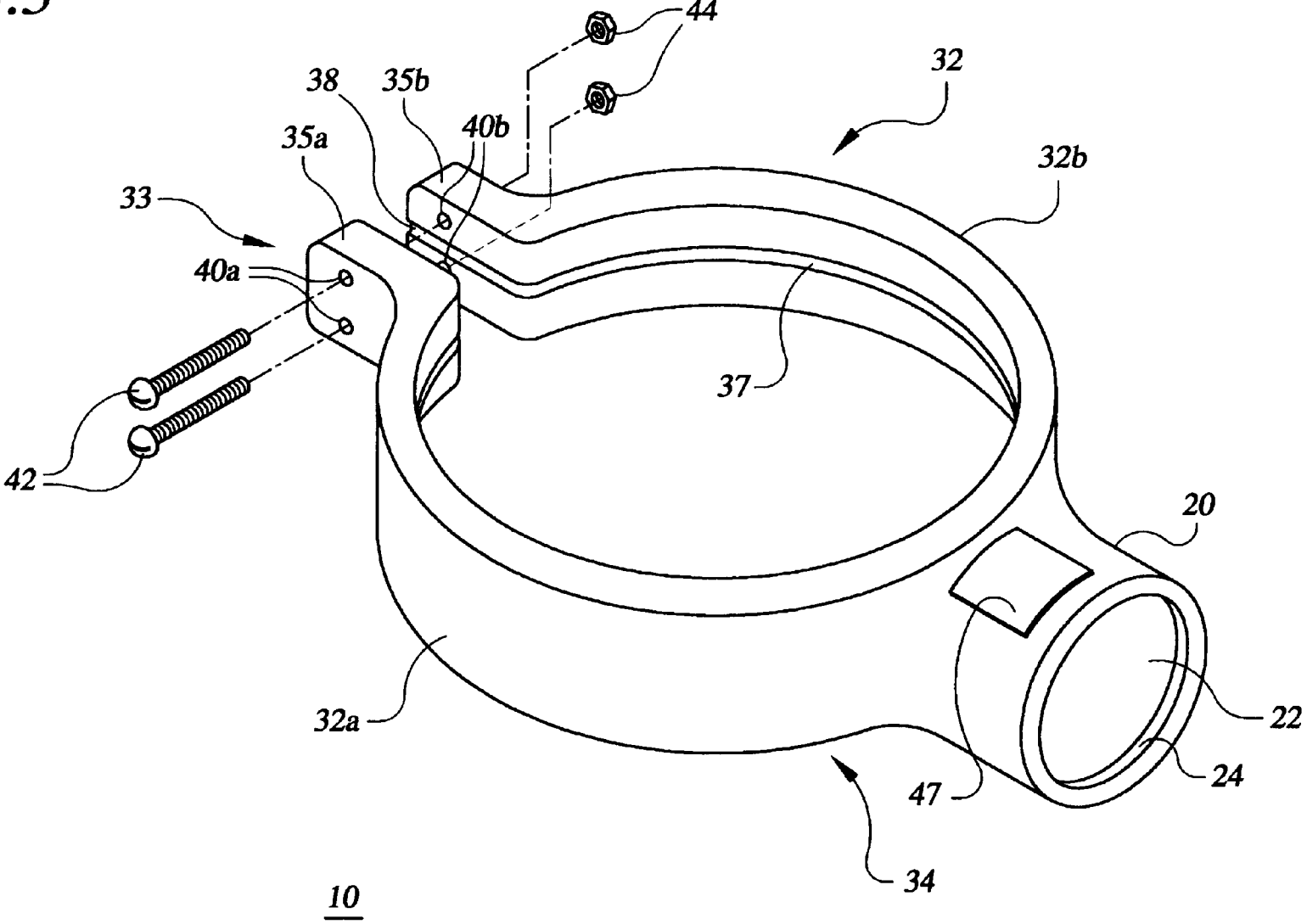
FIG. 3 is an isometric view of the TMTM.

Referring now to the drawings in more detail, the preferred embodiment of the Trolling Motor Transducer Mount is shown in FIGS. 1,2, and 3, and is generally designated by the numeral 10. The TMTM 10 is essentially a circular collar 32 with an open end 33 and a closed end 34. The closed end 34 of the circular collar 32 extends outward to form a housing for mounting a transducer. The housing secures the transducer in place on the TMTM 10 and shields the transducer from any direct impact from underwater obstructions or debris. In the preferred embodiment, this is a cylindrical housing 20 with a recess 22 sized to contain a standard transducer. So, the recess 22 is approximately 1.5 inches in diameter in the preferred embodiment. The axis for the cylindrical housing 20 is perpendicular to the axis for the circular collar 32, so that when the circular collar 32 is properly positioned on a trolling motor (with its axis parallel to that for the trolling motor), the cylindrical housing 20 is directed away from the trolling motor. Essentially, the circular collar 32 is comprised of two semicircular brackets 32a and 32b which are each attached at one end to the cylindrical housing 20, to form the closed end 34 of the circular collar 32, with the other ends of the semicircular brackets 32a and 32b approaching but not contacting one another to form the open end 33 of the circular collar 32.

The circular collar 32 is sized to fit the trolling motor upon which the TMTM 10 is to be mounted. Since most of the trolling motor market is currently comprised of two sizes of trolling motors (MOTORGUIDE® and standard MINN KOTA® or MAGNUM MINN KOTA™ trolling motors), the circular collar 32 in the preferred embodiment will typically be either approximately 4.025 inches in inner diameter or approximately 3.710 inches in inner diameter. Also, in the preferred embodiment, the circular collar 32 is approximately 1.25 inches wide and approximately 0.375 inches thick. The additional bulk of the circular collar 32 provides additional strength and durability over the hose clamps currently used, and the larger surface area allows the friction force to effectively hold the TMTM 10 in place on a trolling motor (as is described in detail below). Obviously, these specific dimensions are not required for the TMTM 10 to function; rather, the dimensions may be varied as needed in the design process so long as the TMTM 10 is sufficiently strong and durable, and so long as the inner surface area is sufficiently large for the friction forces to tightly secure the TMTM 10 in place on a trolling motor. The TMTM 10 may also be made with an adjustable circular collar 32, which would allow a single TMTM 10 device to fit different sizes of trolling motors. For example, an adjustable TMTM 10 may be formed in such away so that the size of the collar 32 is varied to fit securely onto different size trolling motors by the amount of tightening of the open end 33 of the collar 32.

A means for clamping the free ends of brackets 32*a* and 32*b* closer together is located at the open end 33 of the circular collar 32. In the preferred embodiment, this is accomplished using one or more nuts 44 and bolts 42 with flanges 35*a* and 35*b* rigidly attached to brackets 32*a* and 32*b*. While the flanges 35*a* and 35*b* are described herein as rigidly attached to the brackets 32*a* and 32*b*, this is meant to include single elements formed to include both a bracket 32 and a flange 35. In fact, the preferred embodiment is machined from a single block of aluminum, so all of the rigid attachments of elements are actually the result of a unitary design.

Flange 35*a* is rigidly attached to the free end of bracket 32*a* in a perpendicular manner. Flange 35*a* has one or more holes 40*a* (corresponding to the number of bolts 42 to be used to clamp the brackets 32*a* and 32*b* together) which penetrate completely through the flange 35*a*. Flange 35*b* is likewise rigidly attached to the free end of bracket 32*b* and has one or more holes 40*b* which penetrate completely through the flange 35*b*. Thus, flange 35*a* and flange 35*b* are parallel to each other, with their holes aligning so that one or more bolts 42 may be inserted through the one or more holes 40 in both flanges 35*a* and 35*b*. In order to clamp the brackets 32*a* and 32*b* closer together, the one or more bolts 42 are inserted through the holes 40 in both flanges 35*a* and 35*b*. The bolts 42 are sufficiently long so that they extend through the holes 40 on each of the flanges 35*a* and 35*b*. A nut 44 is screwed onto the open end of each bolt 42. By tightening the nuts 44 onto the bolts 42, the flanges 35*a* and 35*b* are brought into closer proximity, reducing the radius of the circular collar 32. Obviously, this is just one means for clamping the free end of brackets 32*a* and 32*b* together. Other means could also be used, as will readily be apparent to a person skilled in this field. Threaded holes 40, for example, may be an alternative to using nuts 44. Or, a completely external vise could be used to force the brackets 32*a* and 32*b* closer together.

In the preferred embodiment, the cylindrical housing 20 is hollow, such that it encompasses a recess 22 sized to contain a standard transducer. Thus, the transducer will be sheltered within the cylindrical housing 20, so that it is shielded from direct impact with underwater obstructions or debris. A means for holding a transducer in place in the recess 22 must be used on the cylindrical housing 20. In the preferred embodiment, this is accomplished using a lip 24. The lip 24 faces inward on the outermost end of the cylindrical housing 20, such that the inner radius of the cylindrical housing 20 at the outermost end is less than the inner radius of the cylindrical housing 20 at all other points along its length. Thus, a transducer may be slid into the recess 22 through the innermost end of the recess 22 in the cylindrical housing 20 until it contacts the lip 24 at the outermost end of the cylindrical housing 20. Then, the transducer will be held in place as it is wedged between the lip 24 and the trolling motor when the circular collar 32 is properly positioned upon a trolling motor. As will be apparent to those skilled in the field, other means for holding a transducer in place, such as inward facing radial screws inserted into holes around the outer perimeter of the housing, a wire cage covering the recess in the housing, a glass cover which screws onto the exterior opening face of the recess in the housing, or even a glue or putty lining the inside of the recess 22, may be also used. The advantage of the lip used in the preferred embodiment is that it provides a fully integrated unit which allows a transducer to be simply and securely installed into the TMTM 10 without blocking or limiting the transducer's sonar signal, while also allowing the transducer to be easily removed from the TMTM 10 for repair.

The TMTM 10 also typically includes a means for securing the wiring of the transducer so that the wires will not snag on underwater obstructions. In the preferred embodiment, there is a groove 37 on the inner surface of at least one of the brackets 32*a* or 32*b* of the circular collar 32 which runs the entire length of the bracket 32*a* or 32*b*. This groove 37 is designed to provide a space for the wires from the transducer, holding the wires internally so that they are shielded from snagging on any underwater obstacles or debris. In the preferred embodiment, the groove 37 extends over the length of both brackets 32*a* and 32*b*, so that the entire length of the inner surface of the circular collar 32 is grooved. This provides extra space for housing additional wires if necessary. Also, in the preferred embodiment, the groove 37 is located half-way up the height of the circular collar 32, so that the groove 37 runs along the center of the inner surface of the circular collar 32. In the preferred embodiment, the groove 37 is approximately 0.376 inches wide and approximately 0.225 inches deep. Obviously, these specific dimensions are not essential to the invention; rather, the size of the groove 37 may vary so long as it provides sufficient clearance for the transducer wires. And, as will be apparent to those skilled in the field, other means for securing the wiring, such as external ties or clips, may also be used.

There is also a slot 38 cut into at least one of the flanges 35*a* or 35*b* leading inward from its outer edge until it meets the groove 37. In the preferred embodiment, the slot 38 is actually cut symmetrically into both flanges 35*a* and 35*b* to provide a circular tunnel out of the TMTM 10 from the groove 37. Thus, the wires from a transducer may be run from the recess 22, through the groove 37, and out through the slot 38. When the TMTM 10 is properly placed, so that it is near to the shaft of the trolling motor on which the TMTM 10 is to be used, the wires from the transducer will exit the TMTM 10 out of the slot 38, and then will run up along the shaft (being snugly tied to the shaft), out of the water, and into the boat. In this way, the TMTM 10 helps to shield the wires from snagging on any underwater obstacles or debris, as well as shielding the transducer and wires from any electrical interference generated by the trolling motor.

In practice, the means for clamping is used to bring the open ends of the brackets 32*a* and 32*b* together and to reduce the radius of the circular collar 32 so that the circular collar 32 may be tightened around the trolling motor housing onto which the TMTM 10 is to be mounted. By tightening the circular collar 32 around the trolling motor, the TMTM 10 is locked into position on the trolling motor. Thus, the TMTM 10 may be used to rigidly mount a transducer to a trolling motor, while allowing the transducer to later be removed from the trolling motor (by unclamping the brackets 32*a* and 32*b*).

In addition to the mechanical elements of the TMTM 10 described above, the TMTM 10 may serve as a secure mounting location for other electrical instruments. For example, in the preferred embodiment, an electronic temperature gauge 47 may be rigidly attached to the outer surface of the TMTM 10. In that case, a hole may be drilled through the outer surface of the TMTM 10 at the location where the temperature gauge 47 is to be mounted to intersect with the groove 37. Then, the wires from the electronic temperature gauge 47 may be run through the groove 37 and slot 38, so that they too are shielded within the TMTM 10.

The TMTM 10 is used to rigidly, but removably, attach electrical equipment which is to be used underwater, such as a transducer, to a trolling motor, which is placed in the water from a boat. In resting mode, the circular collar 32 is open, with the nuts 44 and bolts 42 removed so that the flanges 35*a* and 35*b* are separate and apart, parallel to one another. The transducer which is intended to be mounted to the trolling motor is slid into place in the recess 22, until the front of the transducer contacts the lip 24 along the inside outer edge of the cylindrical housing 20. The wires from the transducer are then fed into the groove 37 on one of the brackets 32*a* or 32*b* and the slot 38 on the flanges 35*a* and 35*b*.

The circular collar 32 is then slidably placed around the trolling motor housing, typically on the side away from the propeller blades. Preferably, the TMTM 10 is placed close to the shaft leading up towards the boat. With the TMTM 10 in place on the trolling motor, the transducer is H held in place in the recess 22 since it is wedged between the lip 24 and the trolling motor itself. The wires are also held in place in the groove 37 by the trolling motor itself. Typically, when the TMTM 10 is properly positioned on the trolling motor (and the trolling motor is in the vertical position), the cylindrical housing 20 faces directly downward, since that is the proper position for a sonar depth finder. Other positions may, however, be appropriate depending upon the type of electrical equipment and/or transducer being mounted upon the trolling motor.

Figure 4:
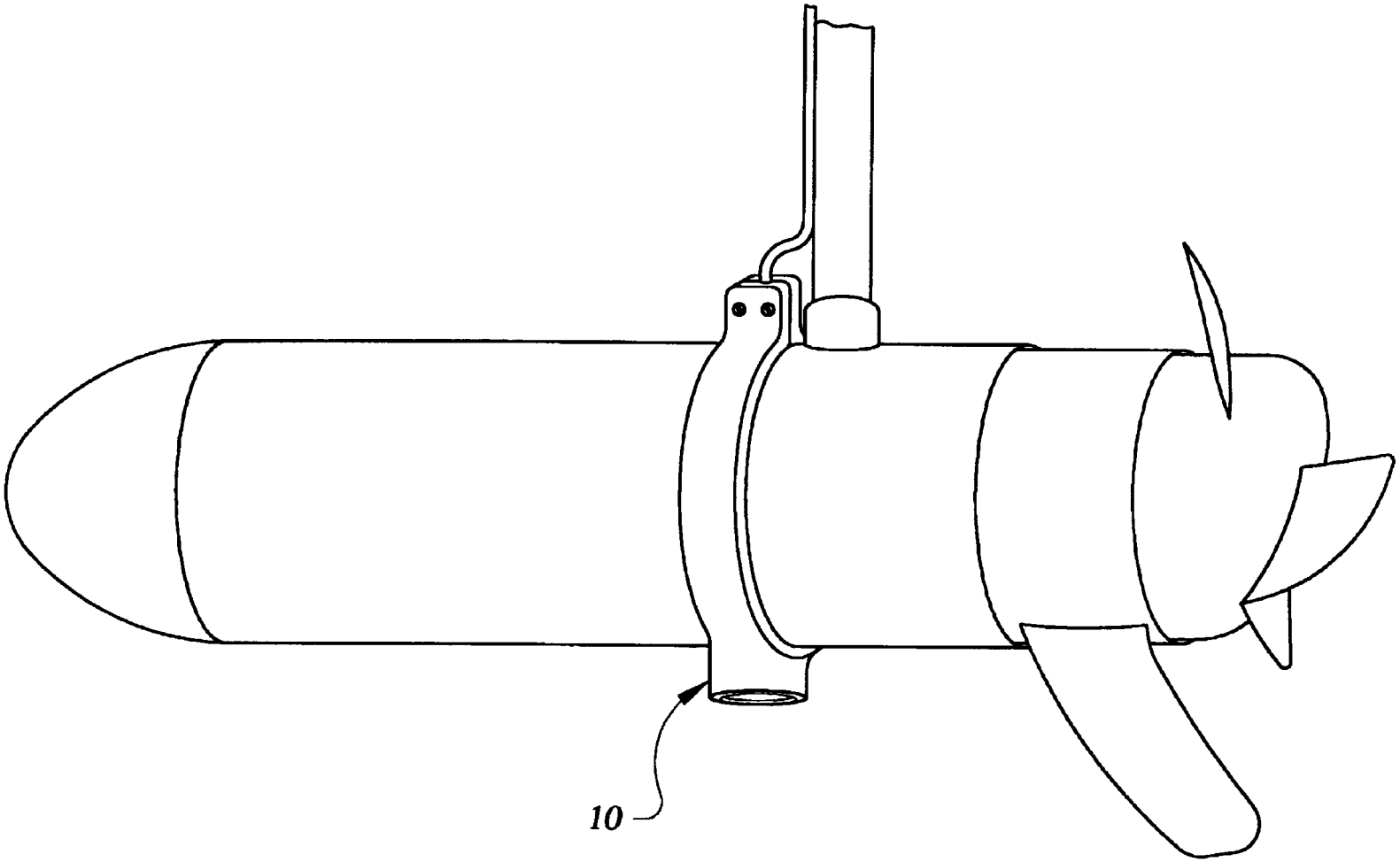
FIG. 4 illustrates the TMTM when it is mounted on a trolling motor.

Once the TMTM 10 is properly positioned upon the trolling motor, the clamping mechanism is used to lock the TMTM 10 in place. In the preferred embodiment, the bolts 42 are inserted through the holes 40 in the flanges 35*a* and 35*b*. The nuts 44 are then screwed onto the ends of the bolts 42 and tightened to the desired position. As the nuts 44 are tightened, the flanges 35*a* and 35*b* are brought closer together, thereby drawing the two brackets 32*a* and 32*b* together and reducing the radius of the circular collar 32. As the radius of the circular collar 32 is reduced, it will tighten around the trolling motor on which the TMTM 10 is located, until the TMTM 10 is locked into position on the trolling motor. The friction force, which locks the TMTM 10 in place on the trolling motor, is increased by tightening the circular collar 32, since this increases the normal forces on the inner surface of the circular collar 32 and the trolling motor. Thus, the TMTM 10 is rigidly attached to the trolling motor, but may be removed by loosening the nuts 44 on the bolts 42 to cause the brackets 32*a* and 32*b* to separate from one another, thereby enlarging the radius of the circular collar, reducing the friction force, and allowing the TMTM 10 to be slidably removed from the trolling motor. FIG. 4 illustrates the TMTM 10 when mounted in the typical manner upon a trolling motor.

Although the TMTM 10 could be constructed of any materials which were sufficiently strong, durable, and corrosion resistant, in the preferred embodiment the TMTM 10 is constructed primarily of aluminum. In the preferred embodiment, the circular collar 32, the cylindrical housing 20 and the flanges 35*a* and 35*b* are all 6061-T651 aluminum. The hardware, such as the nuts 44 and bolts 42, are stainless steel. Other materials, such as stainless steel and certain plastics, could also be used for the TMTM 10. The TMTM 10 can also be constructed in many ways. The appropriate construction technique will generally depend upon the materials being used to construct the TMTM 10, along with the degree of strength and durability needed. In the preferred embodiment, the TMTM 10 is machined out of a solid block of aluminum. All burrs are then removed, and all sharp comers are broken away. The aluminum is then anodized black in order to improve its corrosion resistance capabilities.

The specific embodiments and uses set forth herein are merely illustrative examples of the preferred embodiment of the TMTM 10 invention and are not intended to limit the present invention. A person skilled in the field will understand and appreciate additional embodiments and uses, which are also included within the scope of the present invention. The scope of the invention is fully defined in the following claims, and the only limits to the invention are those set forth within the claims below.

What I claim is:

1. A trolling motor transducer mount comprising:

a housing;

a collar which is open at one end and closed at the opposite end, said housing being rigidly attached to said collar;

a means for clamping said collar; and a means for securing a transducer within said housing;

wherein said collar is further comprised of two brackets, wherein one end of each of said brackets is rigidly attached to said housing, forming said closed end of said collar, and the remaining ends of each of said brackets approach but do not contact one another, forming said open end of said collar; and wherein said collar further comprises a groove, wherein said groove extends along the length of one of said brackets from the connection of said bracket to said housing to said open end of said bracket.

2. A trolling motor transducer mount comprising:

a housing;

a collar which is open at one end and closed at the opposite end, said housing being rigidly attached to said collar;

a means for clamping said collar; and a means for securing a transducer within said housing;

wherein said collar is further comprised of two brackets, wherein one end of each of said brackets is rigidly attached to said housing, forming said closed end of said collar, and the remaining ends of each of said brackets approach but do not contact one another, forming said open end of said collar; and wherein said housing is cylindrical in shape and wherein said cylindrical housing further comprises a recess.

3. A trolling motor transducer mount as in claim 2 wherein said collar further comprises a groove, wherein said groove extends along the length of the inner surface of one of said brackets, from the connection of said bracket to said housing to said open end of said bracket.

4. A trolling motor transducer mount as in claim 3:

wherein said cylindrical housing further comprises an inner face, which is the end of said cylindrical housing rigidly attached to said closed end of said collar, and an outer face, which is the remaining end of said cylindrical housing opposite said closed end of said collar and which extends out away from said collar; and wherein said means for securing a transducer within said housing is a lip on the outer face of said cylindrical housing which projects inward radially to partially cover said recess.

5. A trolling motor transducer mount as in claim 4 wherein said means for clamping said collar is further comprised of:

two flanges with one or more holes each, wherein one of said flanges is rigidly attached to the open end of one of said brackets, while the other of said flanges is rigidly attached to the open end of the other of said brackets;

one or more bolts; and one or more nuts.

6. A trolling motor transducer mount as in claim 5 wherein each of said flanges further comprises a slot which extends outward from said groove.

7. A trolling motor transducer mount as in claim 5 wherein said collar, said housing, and said flanges are formed as a single unit.

8. A trolling motor transducer mount as in claim 3 further comprising a temperature probe.

9. A trolling motor transducer mount as in claim 6 further comprising a temperature probe.

10. A trolling motor transducer mount as in claim 6 wherein said collar is sized to fit onto a trolling motor with a diameter of approximately 4.025 inches.

11. A trolling motor transducer mount as in claim 6 wherein said collar is sized to fit onto a trolling motor with a diameter of approximately 3.710 inches.

12. A trolling motor transducer mount as in claim 6 wherein said collar and said housing are made of aluminum.

13. A trolling motor transducer mount as in claim 6 wherein said collar is approximately 0.375 inches thick and approximately 1.25 inches wide.

14. A trolling motor transducer mount as in claim 12 wherein the aluminum of said collar and said housing is anodized.

15. A trolling motor transducer mount comprising:

a cylindrical housing with a recess;

a circular collar further comprised of two semi-circular brackets, with one end of each of said brackets rigidly attached to said cylindrical housing, and the remaining end of each of said brackets approaching but not contacting one another, such that there is an opening in said circular collar on the end away from said cylindrical housing;

a means for clamping said circular collar; and a means for securing a transducer within said recess of said cylindrical housing.

16. A trolling motor transducer mount as in claim 15 wherein said circular collar further comprises a groove, wherein said groove extends along the length of the inner surface of at least one of said brackets.

17. A trolling motor transducer mount as in claim 15:

wherein said cylindrical housing further comprises an inner face, which is the end of said cylindrical housing rigidly attached to said closed end of said collar, and an outer face, which is the remaining end of said cylindrical housing opposite said closed end of said collar and which extends out away from said collar; and wherein said means for securing a transducer within said housing is a lip on the outer face of said cylindrical housing which projects inward radially to partially cover said recess.

18. A trolling motor transducer mount as in claim 15 wherein said means for clamping said collar is further comprised of:

two flanges, each of which has one or more holes, wherein one of said flanges is rigidly attached to the open end of one of said brackets, while the other of said flanges is rigidly attached to the open end of the other of said brackets; and one or more bolts.

19. A trolling motor transducer mount as in claim 15 further comprising a temperature probe.

20. A trolling motor transducer mount as in claim 15 wherein said circular collar and said cylindrical housing are made of anodized aluminum.

21. A trolling motor transducer mount comprising:

a cylindrical housing further comprised of a recess and a lip which projects inward radially to partially cover said recess;

a circular collar with a groove which runs the entire length of the inner surface of said circular collar, said circular collar further comprised of two semi-circular brackets, with one end of each of said brackets rigidly attached to said cylindrical housing, and the remaining end of each of said brackets approaching but not contacting one another, such that there is an opening in said circular collar on the end away from said cylindrical housing;

two flanges, each of which has one or more holes and a slot which extends outward from said groove on said circular collar, wherein one of said flanges is rigidly attached to the open end of one of said brackets, while the other of said flanges is rigidly attached to the open end of the other of said brackets;

one or more bolts; and one or more nuts.

22. A trolling motor transducer mount as in claim 21 wherein said collar is approximately 0.375 inches thick and approximately 1.25 inches wide.

23. A trolling motor transducer mount as in claim 21 wherein said collar is sized to fit onto a trolling motor with a diameter of approximately 4.025 inches.

24. A trolling motor transducer mount as in claim 21 wherein said collar is sized to fit onto a trolling motor with a diameter of approximately 3.710 inches.

25. A trolling motor transducer mount as in claim 21 further comprising a temperature probe.

26. A trolling motor transducer mount as in claim 21 wherein said collar, said housing, and said flanges are made of anodized aluminum and are machined as a single unit from a block of aluminum.

* * * * *